US008332229B2

(12) United States Patent
et al.

(10) Patent No.: US 8,332,229 B2
(45) Date of Patent: Dec. 11, 2012

(54) LOW COMPLEXITY MPEG ENCODING FOR SURROUND SOUND RECORDINGS

(75) Inventors: Samsudin , Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 940 days.

(21) Appl. No.: 12/405,133

(22) Filed: Mar. 16, 2009

(65) Prior Publication Data

US 2010/0169102 A1 Jul. 1, 2010

Related U.S. Application Data

(60) Provisional application No. 61/141,386, filed on Dec. 30, 2008.

(51) Int. Cl.
*G10L 19/00* (2006.01)
*H04R 5/027* (2006.01)

(52) U.S. Cl. ..... 704/500; 381/307

(58) Field of Classification Search ..... None
See application file for complete search history.

(56) References Cited

U.S. PATENT DOCUMENTS 5,632,005 A * 5/1997 Davis et al. ..... 704/504
7,450,727 B2 * 11/2008 Griesinger ..... 381/119
8,041,043 B2 * 10/2011 Faller ..... 381/26
2005/0157894 A1 * 7/2005 Andrews et al. ..... 381/307
2007/0009115 A1 * 1/2007 Reining et al. ..... 381/122
2010/0174548 A1 * 7/2010 Beack et al. ..... 704/503

OTHER PUBLICATIONS

Breebaart, Jeroen, et al., "Background, Concept, and Architecture for the Recent MPEG Surround Standard on Mutlichannel Audio Compression," May 2007, 331-351, J. Audio Eng. Soc., vol. 55, No. 5.
Purnhagen, Heiko, "Some Mathematics Behind Multi-Channel Prediction," Sep. 30, 1994, 1-8, Institut fur Theoretische Nachrichtentechnik and Informationsverarbeitung, Uni Hannover.
Cd 11172-3 Coding of Moving Pictures and Associated Audio for Digital Storage Media At Up to About 1.5 MBIT/s Part 3 Audio Contents, 38 pgs., Nov. 22, 1991.
3-Annex A (informative) Diagrams, CD 11172-3 Coding of Moving Pictures and Associated Audio for Digital Storage Media At Up to About 1.5 MBIT/s Part 3 Audio Contents, 41 pgs., Nov. 22, 1991.
3-Annex C (informative) The Encoding Process, CD 11172-3 Coding of Moving Pictures and Associated Audio for Digital Storage Media At Up to About 1.5 MBIT/s Part 3 Audio Contents, 43 pgs., Nov. 22, 1991.

(Continued)

*Primary Examiner* — Talivaldis Ivars Smits
(74) *Attorney, Agent, or Firm* — Hogan Lovells US LLP

(57) ABSTRACT

The invention provides for the encoding of surround sound produced by any coincident microphone techniques with coincident-to-virtual microphone signal matrixing. An encoding scheme provides significantly lower computational demand, by deriving the spatial parameters and output downmixes from the coincident microphone array signals and the coincident-to-surround channel-coefficients matrix, instead of the multi-channel signals.

19 Claims, 9 Drawing Sheets

OTHER PUBLICATIONS

3-Annex D (informative) Psychoacoustic Models, CD 11172-3 Coding of Moving Pictures and Associated Audio for Digital Storage Media At Up to About 1.5 MBIT/s Part 3 Audio Contents, 40 pgs., Nov. 22, 1991.

3-Annex E (informative) Bit Sensitivity to Errors, CD 11172-3 Coding of Moving Pictures and Associated Audio for Digital Storage Media At Up to About 1.5 MBIT/s Part 3 Audio Contents, 6 pgs., Nov. 22, 1991.

Informative Technology—Coding of Audio-Visual Objects—Part 3: Audio Amendment 2: Parametric coding for high-quality audio, Aug. 2004, i-116, ISO/IEC 14496-3:2001/Amd.2:2004(E), Aug. 1, 2004.

Information Technology—MPEG Audio Technologies—Part 1: MPEG Surround, Feb. 2007, i-280, ISO/IEC 23003-1:2007(E).

Subpart 4: General Audio (GA) Coding: AAC/TwinVQ, 1-226, ISO/IEC 14496-3:1999(E), 1999.

* cited by examiner

LOW COMPLEXITY MPEG ENCODING FOR SURROUND SOUND RECORDINGS

RELATED APPLICATION

The present application relates to and claims the benefit of priority to U.S. Provisional Patent Application No. 61/141,386 filed Dec. 30, 2008, which is hereby incorporated by reference in its entirety for all purposes as if fully set forth herein.

BACKGROUND OF THE INVENTION

1. Field of the Invention

Embodiments of the present invention relate, in general, to the field of surround sound recording and compression for transmission or storage purposes and particularly to those recording and compression devices involving low power.

2. Relevant Background

Surround sound recording typically requires complex multi-microphone setup with large inter-microphone spacing. However, there are scenarios wherein such complex setup is not possible. As an example, a video recorder with surround sound recording capability can be integrated as a feature in mobile phones. Obviously, the surround microphone array has to be very compact due to the limited mounting area. One means to integrate surround microphone recording in a limited mounting area is by using coincident microphone techniques. Such techniques utilize the psychoacoustic principles of Inter-aural Level Differences ("ILD") to record and recreate the audio scene during surround sound playback. Coincident microphones require a minimum of three first-order directional microphones arranged so that the polar patterns of these microphones coincide on a horizontal plane. Some of the popular microphone setups for coincident surround recording are:

1. Double Mid/Side ("DMS") array which consists of front-facing cardioid (mid-front), side-facing bidirectional (side) and rear-facing cardioid (mid-rear) microphones, 2. FLRB array which consists of front (F), left (L), right (R), and rear (B) facing cardioid microphones, and 3. B-format microphone array which consists of three or four microphones and additional signal processing to produce coincident B-format signals with omnidirectional (W), front-facing bidirectional (X) and side-facing bidirectional (Y) responses required for horizontal surround sound production.

FIGS. 1(*a*) and (*b*) shows the polar pattern of DMS and B-format microphone array signals, respectively, as known in the prior art. Each microphone produces directional signals that when weighted can be combined to form a virtual microphone signal. By properly designing the weighting factors, unlimited number of virtual microphone signals can be derived having first-order directivity pointing to any directions around the horizontal plane. Surround sound is obtained by deriving one virtual microphone signal for each surround sound channel. In this context, the weighting factors to derive each surround audio channel's signal are designed such that the resulting virtual microphone is pointing to the direction which corresponds to the location of the speaker in the surround playback configuration. This set of weighting factors will be referred to herein as channel coefficients. For example, a surround channel $C_i$ is derived from B-format signals and its channel coefficients ($\alpha_i$, $\beta_i$, $\gamma_i$) can be determined according to the equation $$C_i=\alpha_i W+\beta_i X+\gamma_i Y.$$

FIG. 2 shows the typical virtual-microphone polar pattern for a standard International Telecommunication Union (ITU) 5.0 surround sound signal as known in the prior art. In this example, the channel coefficients have been designed such that the virtual microphones for the center (C) 210, left-front (L) 220 and right-front (R) 230 surround channels possess supercardioid directivity and point to 0° and ±30°, respectively, while the virtual microphones for the left-surround (Ls) 240 and right-surround (Rs) 250 surround channel possess cardioid directivity and point to and ±110°, respectively.

In practice, the coincident-to-virtual microphone processing is implemented as a hardware matrix which attenuates and combines the microphone array signals according to a channel-coefficients matrix. The resulting signals thereafter are stored for distribution or playback. Due to the multi-channel signal representation, a significant amount of memory space and transmission bandwidth is required. This requirement scales up linearly with the number of surround sound channels. To achieve efficient storage and transmission, signal compression needs to be employed. State-of-the-art perceptual or hybrid audio compression schemes such as Moving Pictures Expert Group ("MPEG")-1 layer 3 and Advanced Audio Coder compress monaural or stereo audio signals very efficiently. However for multi-channel signals, the required data rate scales up with the number of surround sound channels making efficient compression challenging.

Recently, MPEG Surround ("MPS") has been standardized as a multi-channel audio compression scheme which represents surround sound by a set of downmix signals (with a lower number of channels than the surround sound, eg. monaural or stereo downmix) and low-overhead spatial parameters that describe its spatial properties. A decoder is able to reconstruct the original surround sound channels from the downmix signals and transmitted spatial parameters. When combined with perceptual audio coders to compress the monaural or stereo dowmnix signals, MPS enables an efficient representation of surround sound that is compatible with the existing mono or stereo infrastructure. A generic MPS multi-channel audio encoding structure, as known in the prior art, is shown in FIG. 3.

Time/Frequency ("T/F") analysis 310 consists of an exponential-modulated Quadrature Mirror Filterbank ("QMF") filtering followed by a low-frequency filtering to increase the frequency resolution for the lower subbands. Together, this filtering scheme is referred to as hybrid analysis filtering. The filtering is performed on each surround sound channel to convert the time-domain audio signals into the subband-domain signal representations. The multi-channel subband signals are then passed to a spatial encoding stage 320 that calculates the spatial parameters 340 and performs signal downmixing into a lower number of audio signals. The output-downmix signals are synthesized back into the time domain 330 and can be further compressed using any audio compression schemes, as known to one skilled in the relevant art. Spatial parameters 340 are quantized and formatted 350 according to the spatial audio syntax and typically appended to the downmix-audio bitstream. Optionally, a set of residual signals can be derived and coded according to AAC low-complexity syntax. These coded signals then can be transmitted in the spatial parameter bitstream to enable full waveform reconstruction at the decoder side.

The spatial encoding stage 320 is realized as a tree structure, which comprisies a series of Two-to-One (TTO) and Three-to-Two (TTT) encoding blocks. Representative depictions of a typical TTO and TTT encoding scheme as known to one skilled in the relevant art are shown in FIGS. 4*a* and 4*b*. A TTO encoding block 430 takes a subband-domain signal pair 450 as input, calculates the signal energy and cross-correlation, and groups these values into several parameter bands with non-linear frequency bandwidth. At each parameter band, spatial parameters 460 and downmix scalefactors are calculated. The subband-domain signal pair is thereafter mixed to derive the monaural 465 and residual signals 460. The monaural (summed) signal is subsequently scaled by the downmix scalefactor, which is required to ensure overall energy preservation in the downmix signal. The residual (subtracted) signal 460 is either discarded or coded for transmission in the spatial parameter bitstream. TTT performs similar operations but with three input signals and stereo output-downmix signals. As shown a TTT encoding block 440 produces a stereo downmix from a left, center and right signal combination.

In the stereo-based encoding mode, MPS coding scheme provides the possibility to transmit matrix-compatible or 3D-stereo downmixes 470 instead of the standard stereo downmix. The transmission of matrix-compatible stereo downmix provides backward compatibility with legacy matrixed surround decoders, while 3D stereo downmix provides the advantage of binaural listening for existing stereo playback system. In generic encoding schemes, these downmixes are created by applying a 2×2 post-processing matrix that modifies the energy and phase of the standard stereo dowmmix signal. Upon receiving these downmixes, a standard MPS decoder is able to revert back to the standard stereo downmixes by applying the inverse of the post-processing matrix.

Due to the structure of the encoder, the memory and computational requirement of a MPS encoder is highly dependent on the number of surround audio channels. The computational requirement is magnified by the subband samples having a complex-number representation. MPS hybrid analysis filtering is a computationally intensive scheme and it has to be performed on each of the surround audio channels. This implies that the memory and computational requirement of the encoder scales up linearly with the number of surround audio channels. Furthermore, in the spatial encoding stage, the energy and cross-correlation calculation and subband signal downmixing contribute to substantial computational power as they have to be performed at each encoding block. As the number of surround sound channels, is increased, more TTO and/or TTT blocks are required to encode the extra channels, which increases the overall computational requirement of the encoder. Such dependency is highly inefficient for the encoding of coincident surround sound recording and might become a bottleneck in applications with limited processing power.

In a coincident surround sound recording scheme, the number of the required microphone array signals is less than the number of the derived virtual microphone signals. Furthermore, the same microphone array signals can be used to derive different surround audio signals for different playback configurations simply by changing the size and coefficients of the channel-coefficients matrix. For example, a 5.0 and a 7.0 surround sound signal can be derived from B-format signals by designing the corresponding 3-to-5 and 3-to-7 channel-coefficients matrixes, respectively. It can be seen, therefore, that the required number of coincident microphone signals is independent of the number of surround channels; yet encoding and compression of these channels remains a challenge.

BRIEF SUMMARY OF THE INVENTION

MPEG Surround provides an efficient representation of multi-channel audio signals by using a set of downmix signals and low-overhead spatial parameters that describe the spatial properties of the multi-channel signals. The encoding process is computationally intensive especially for the Time/Frequency analysis filtering and signal downmixing; moreover the computational requirement is highly dependent on the number of surround audio channels. While coincident microphone techniques offer a compact microphone array construction and a low number of microphone signals to produce surround sound recordings, the inefficient encoding scheme may become a bottleneck for low-power applications. The present invention provides a new encoding scheme with significantly lower computational demand by deriving the spatial parameters and output downmixes from the coincident microphone array signals and the coincident-to-surround channel-coefficients matrix instead of the multi-channel signals. The invention is applicable for the encoding of surround sound that is produced by any coincident microphone techniques with coincident-to-virtual microphone signal matrixing.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE SEVERAL VIEWS OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1B:
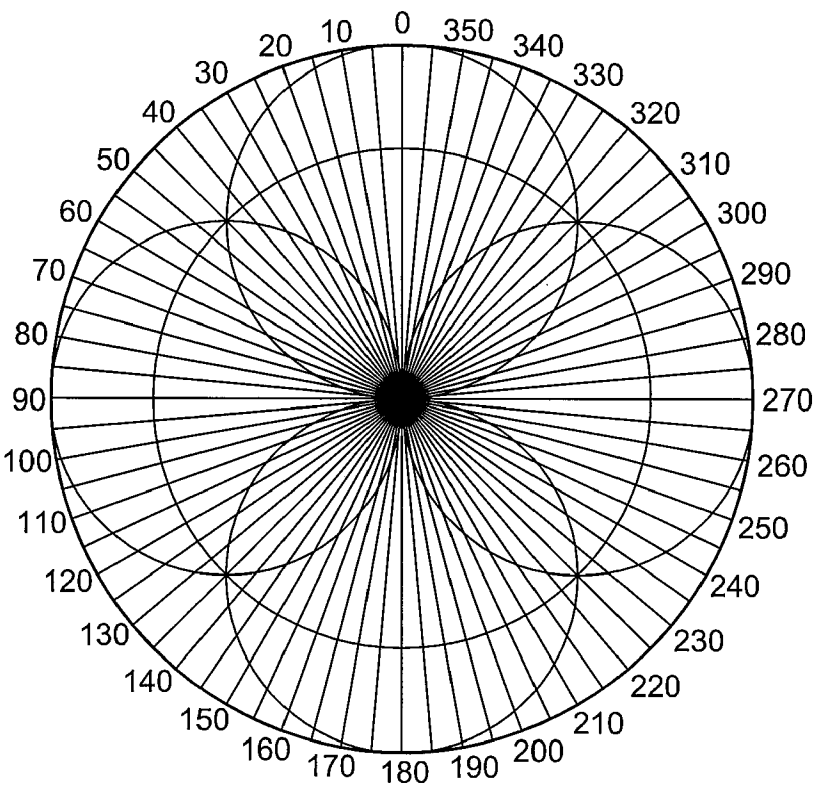
Fig. 1b Prior Art
FIG. 1*b* shows the three horizontal B-format signals produced by B-format microphone, as is known in the prior art.
Figure 1A:
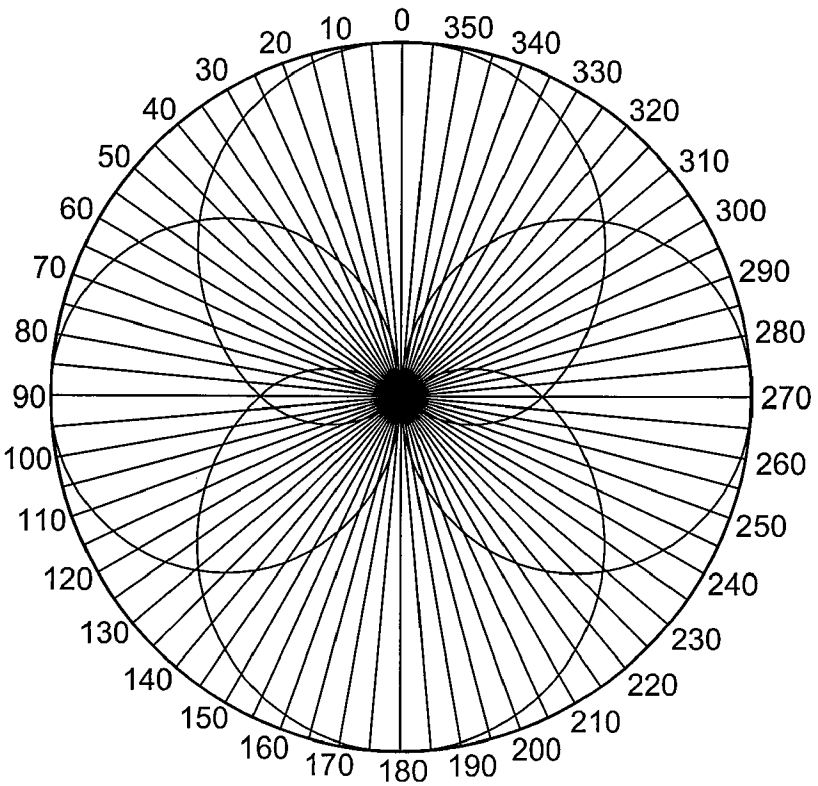
Fig. 1a Prior Art
FIG. 1*a* shows coincident signals produced by a double mid/side microphone array, as is known in the prior art.
Figure 2:
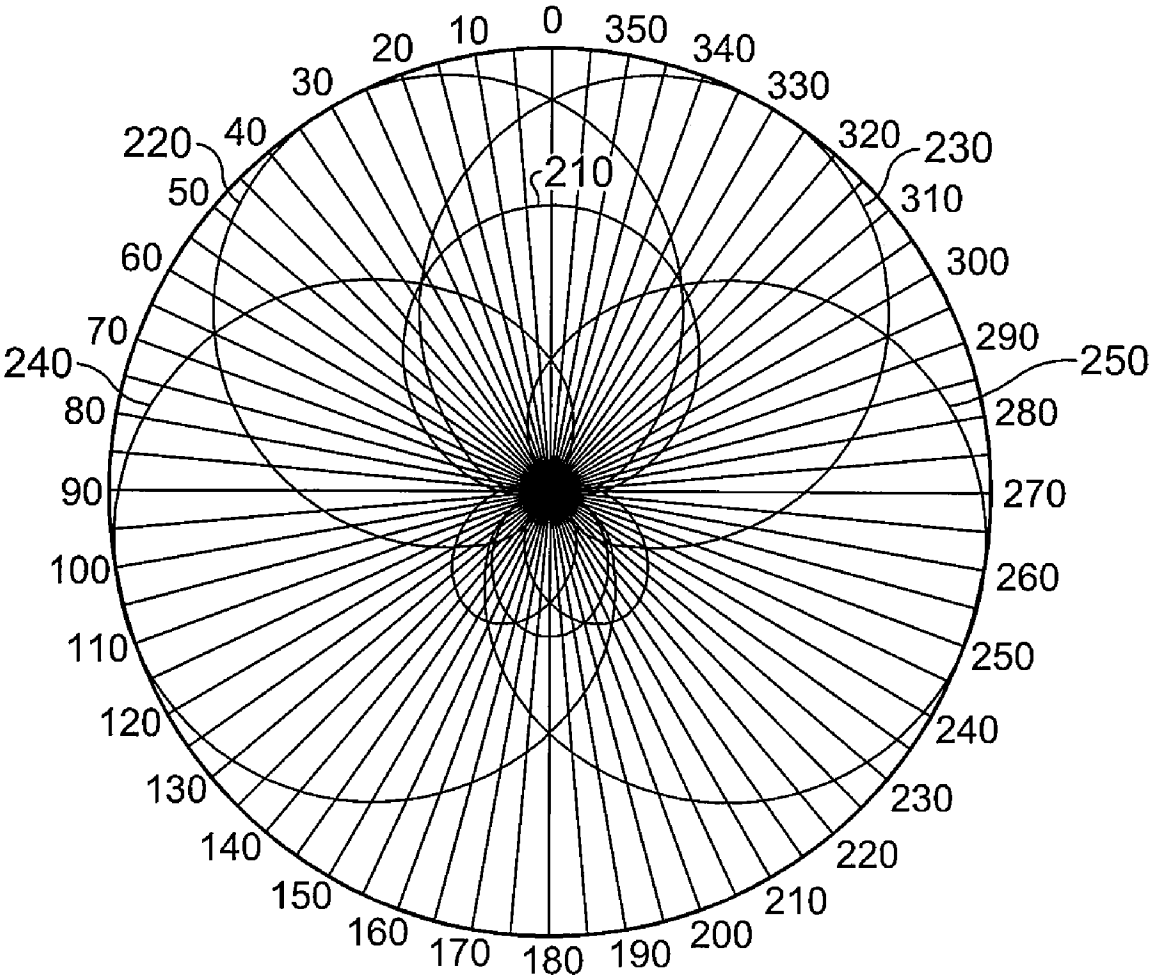
Fig. 2 Prior Art
FIG. 2 shows the typical virtual-microphone polar pattern for ITU 5.0 surround sound signals, as is known in the prior art.
Figure 3:
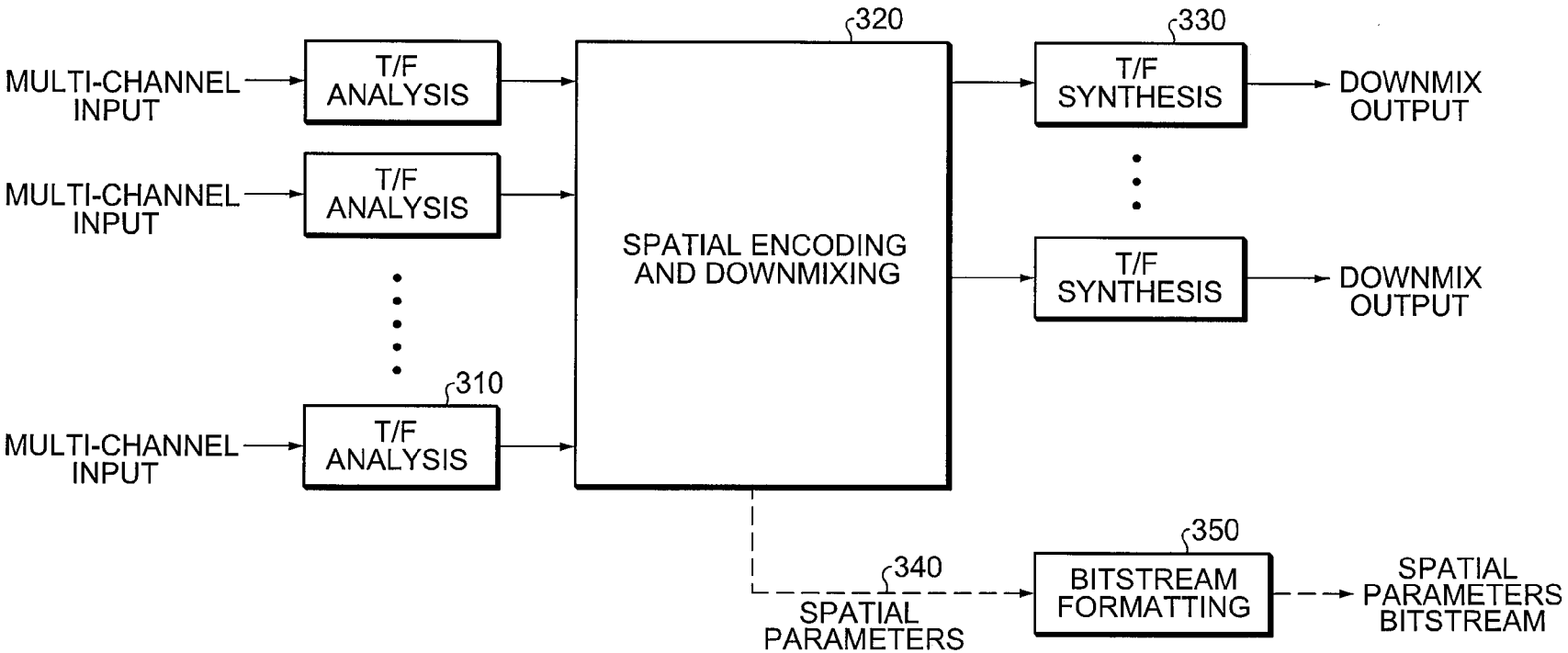
Fig. 3 Prior Art
FIG. 3 shows a generic MPEG Surround encoding scheme as would be known to one skilled in the relevant art.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE INVENTION

Specific embodiments of the present invention are hereafter described in detail with reference to the accompanying Figures. Like elements in the various Figures are identified by like reference numerals for consistency. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

According to one embodiment of the invention, a MPS encoding scheme derives spatial parameters, residual signals, and output-downmix signals from coincident microphone signals and the channel-coefficients matrix rather than multichannel surround sound signals. The analysis filtering utilized in embodiments of the present invention is performed on fewer channels than that of the prior art and, as a result, the memory and computational requirement are reduced. Accordingly the channel signal energy and cross-correlation required to calculate the spatial parameters and downmix scalefactors are calculated without actually deriving the surround sound channels. This is possible because the coincident-to-virtual microphone signal matrixing is a linear operation, hence the channel signal energy and cross-correlation can be calculated from the linear combination of the microphone array signal energy and cross-correlation. One advantage of this embodiment of the present invention is that the signal energy and cross-correlation calculation are only performed once on the microphone array signals, instead of multiple times at each encoding block.

Another advantage of the present invention is that the need to perform signal summation and scaling to derive the downmix signal at each TTO or TTT encoding block is eliminated, again reducing the computational requirement. These signal operations are represented by summation and scaling of the input channel-coefficients pair or triplet. While for simplicity the present description refers to input channel-coefficients, one skilled in the relevant art will recognize that an input channel-coefficient is a type of coincident-to-surround channel coefficient and that the present invention is equally applicable to any coincident-to-surround channel coefficient. In the present example, instead of the actual surround channel signals, only their respective channel coefficients are navigated through the encoding tree. Again, this is possible because signal downmixing and scaling are linear operations. The last encoding block outputs the dowmnix channel-coefficients matrix that is used to derive the output-downmix signals from the microphone array signals.

For a stereo-based encoding configuration, one embodiment of the present invention provides an advantage in terms of the derivation of matrix-compatible or 3D-stereo downmix. The post-processing required to derive downmixes can, according to the present invention, be implemented efficiently by integrating the 2×2 conversion matrix into the stereo-downmix channel-coefficients matrix, practically adding no significant computational requirement.

The computational efficiency of the present invention, as compared to the MPEG Surround encoding schemes known in the prior art, is obvious and is clearly evident as shown in the following example. Assuming that the complexity of each hybrid analysis filtering is f (in terms of the total number of operations), the encoding scheme of the present invention requires $(N-M)\cdot F$ less operations where N and M are the number of the surround sound channels and coincident microphone array signals, respectively. For a conventional 5.1 surround sound (6 surround channels) with a 3-channel B-format coincident recording, this improvement amounts to a complexity savings of 50% for the hybrid analysis filtering alone. On the spatial parameter calculation and signal downmixing for mono-based encoding, the complexity of the generic encoder is estimated to be (40e) multiplications and (40e) additions, where e is the total number of time-frequency points. The complexity of the encoding scheme associated with embodiments of the present invention is estimated to be (19e) multiplications and (17e) additions. Therefore, there is at least a 50% savings on the encoding scheme of the present invention as compared to the generic encoding scheme of the prior art. This saving is significant considering that each encoding frame consists of 71-by-32 time-frequency points.

Figure 5:
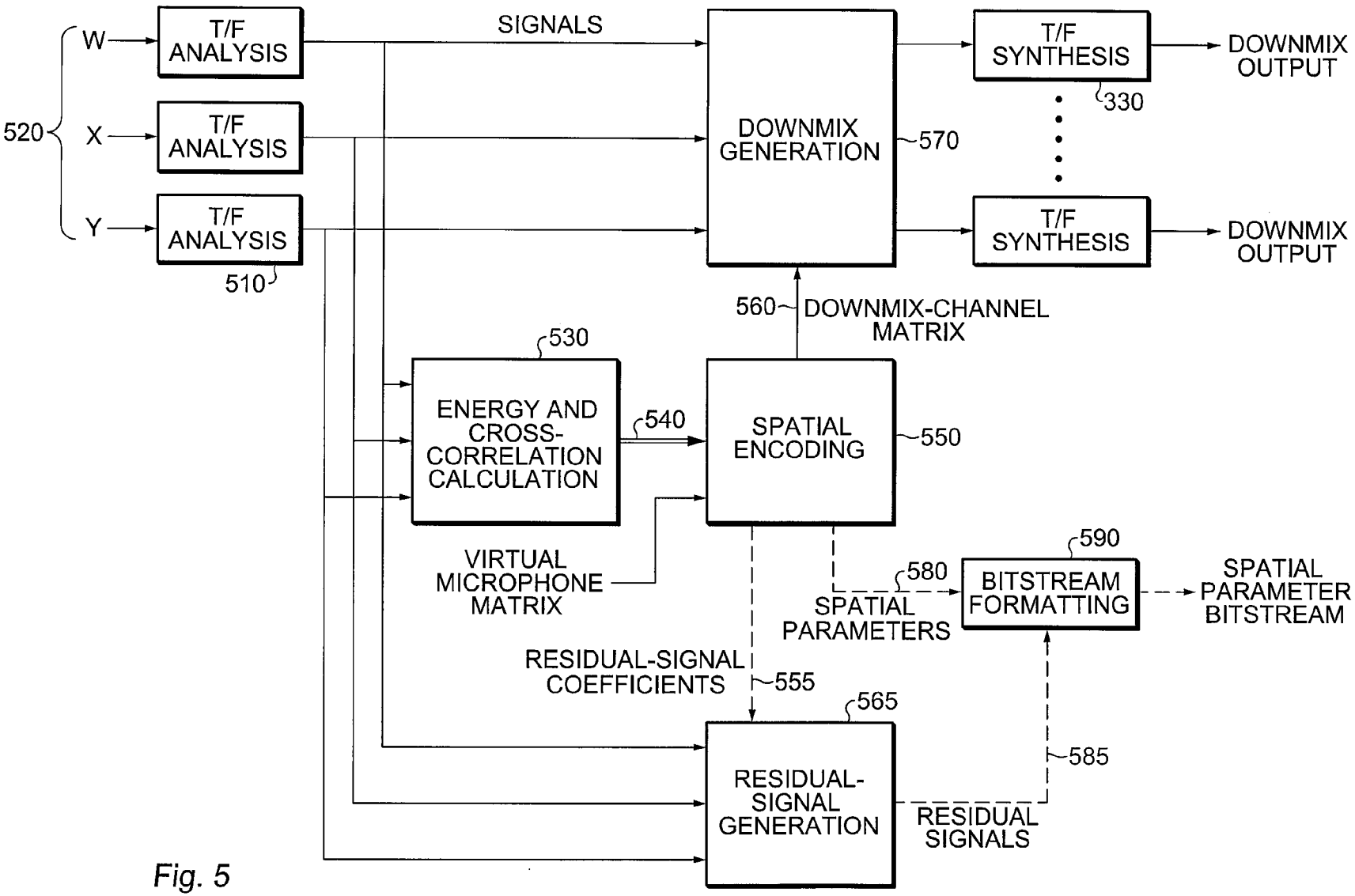
FIG. 5 shows a MPEG Surround encoding scheme for a three-channel coincident microphone array recording according to one embodiment of the present invention.

FIG. 5 shows the diagram of the proposed MPS encoding scheme according to one embodiment of the present invention. For this example, assume commonly used three-channel coincident microphone techniques. For simplicity of signal labeling, B-format signals (W, X and Y) are used. However, as will be recognized by one skilled in the relevant art, the invention is applicable to any coincident surround sound recording techniques with any number of microphone signals that utilize coincident-to-virtual microphone matrixing and is not limited by the B-format signals.

Figures 6A, 6B:
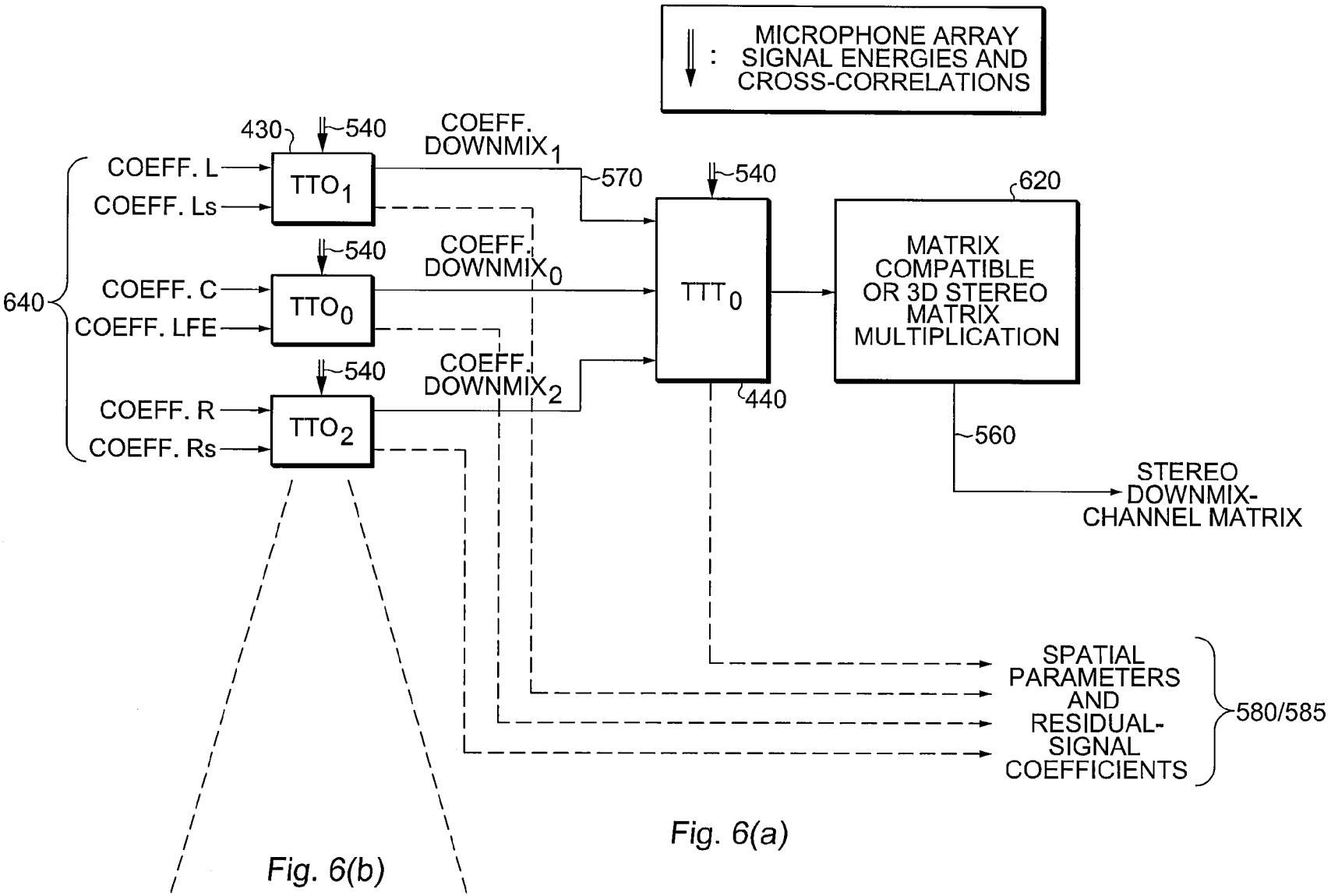
FIG. 6*a* shows a MPEG Surround encoding tree for a stereo-based encoding configuration, according to one embodiment of the present invention.
FIG. 6*b* shows an expanded view of a spatial parameter calculation and channel coefficients mixing diagram as associated with the encoding tree depicted in FIG. 6*a*, according to one embodiment of the present invention.

In the present example, at each frame, hybrid analysis filtering 510 is performed on the B-format signals 520. Signal energy of W, X and Y 520 and cross-correlations between the possible signal pairs W-X, W-Y and X-Y are calculated 530 at a maximum of 28 parameter bands. This set of parameter-band signal energies and cross-correlations form a common input 540 to all TTO and TTT encoding blocks. In this depiction the TTO and TTT encoding blocks are generalized as spatial encoding 550. (additional details are shown in FIGS. 6*a* and 6*b*) From the spatial encoding a downmix-channel matrix 560 is formed which is combined with T/F channel signals to generate downmix signals 570. Thereafter the downmix signals are synthesized back to the time domain 330 thus producing a downmix output. The spatial encoding tree 550 also produces spatial parameters 580 that is bitstream formatted 590 producing a spatial parameter bitstream. An additional result of the spatial encoding 550 are residual-signal coefficients. These coefficients are combined with signals produced by the T/F filtering 510 to generate 565 residual signals 585. These residual signals 585 are combined with spatial parameters 580 and formatted into a bit stream 580

Figure 4A:
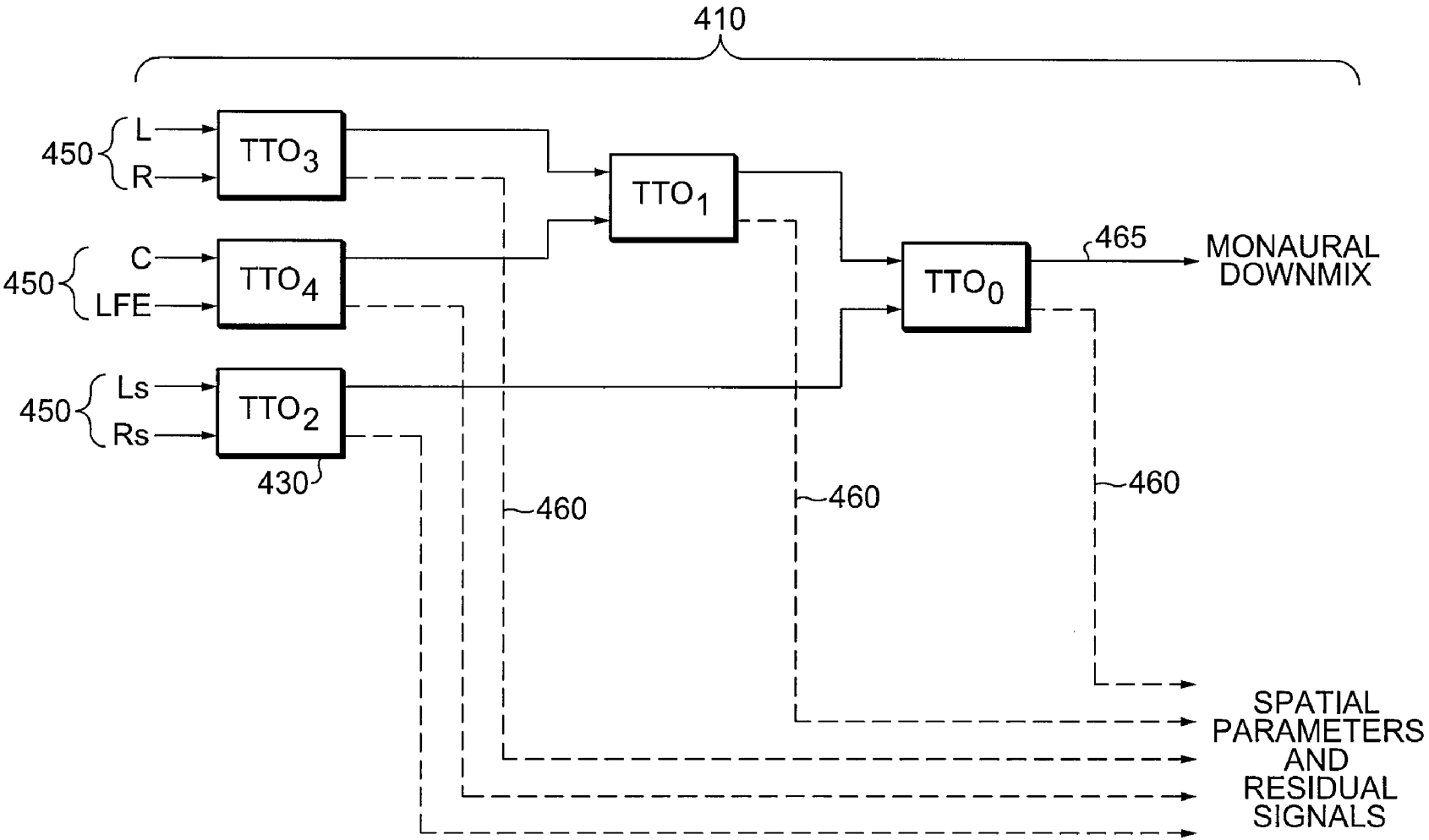
FIG. 4*a* shows a generic MPEG Surround encoding tree for mono-based encoding configuration, as is known in the prior art.
Figure 4B:
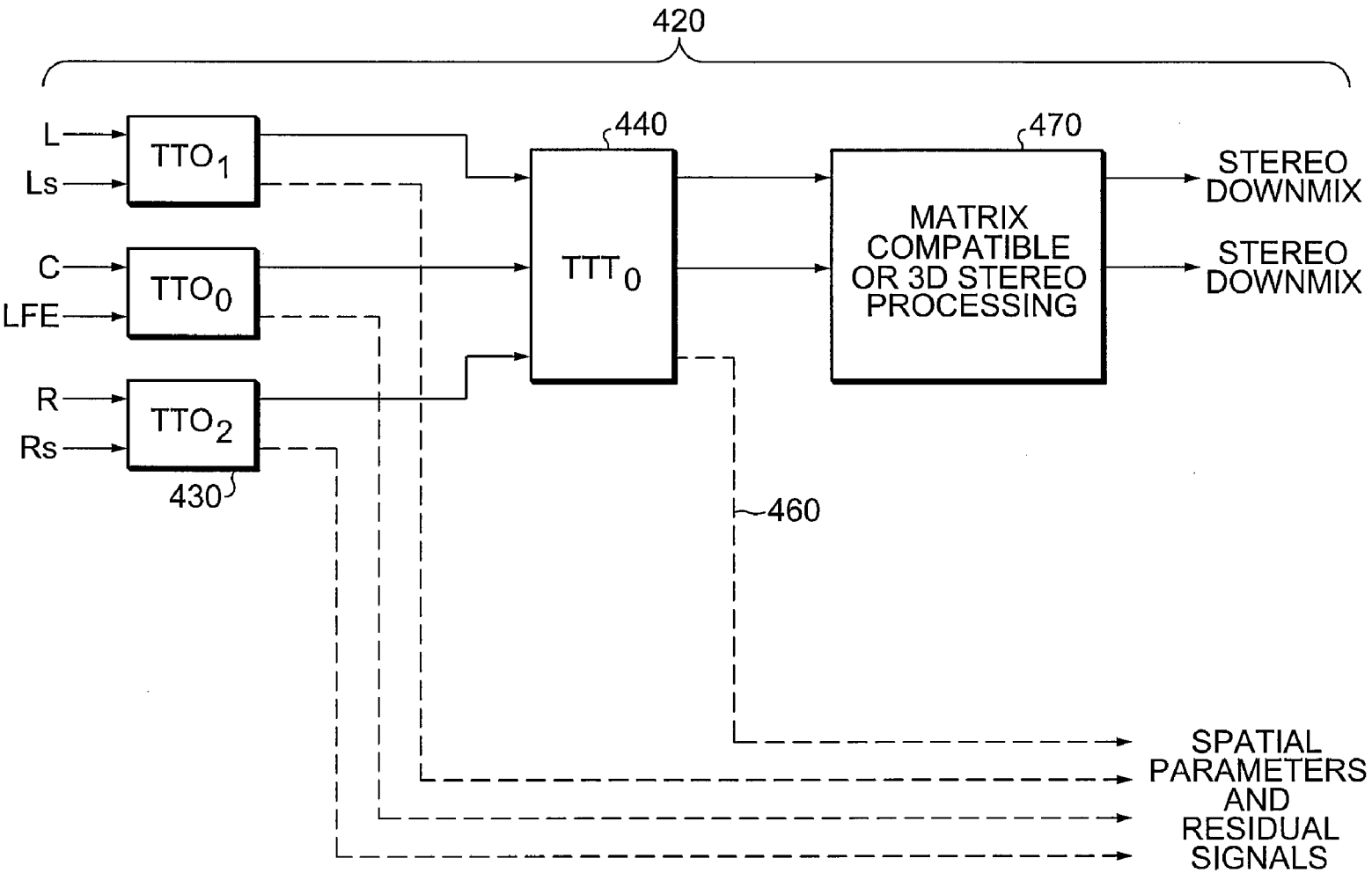
FIG. 4*b* shows a generic MPEG Surround encoding tree for a stereo-based encoding configuration as would be known to one skilled in the relavant art.
Figure 6B:
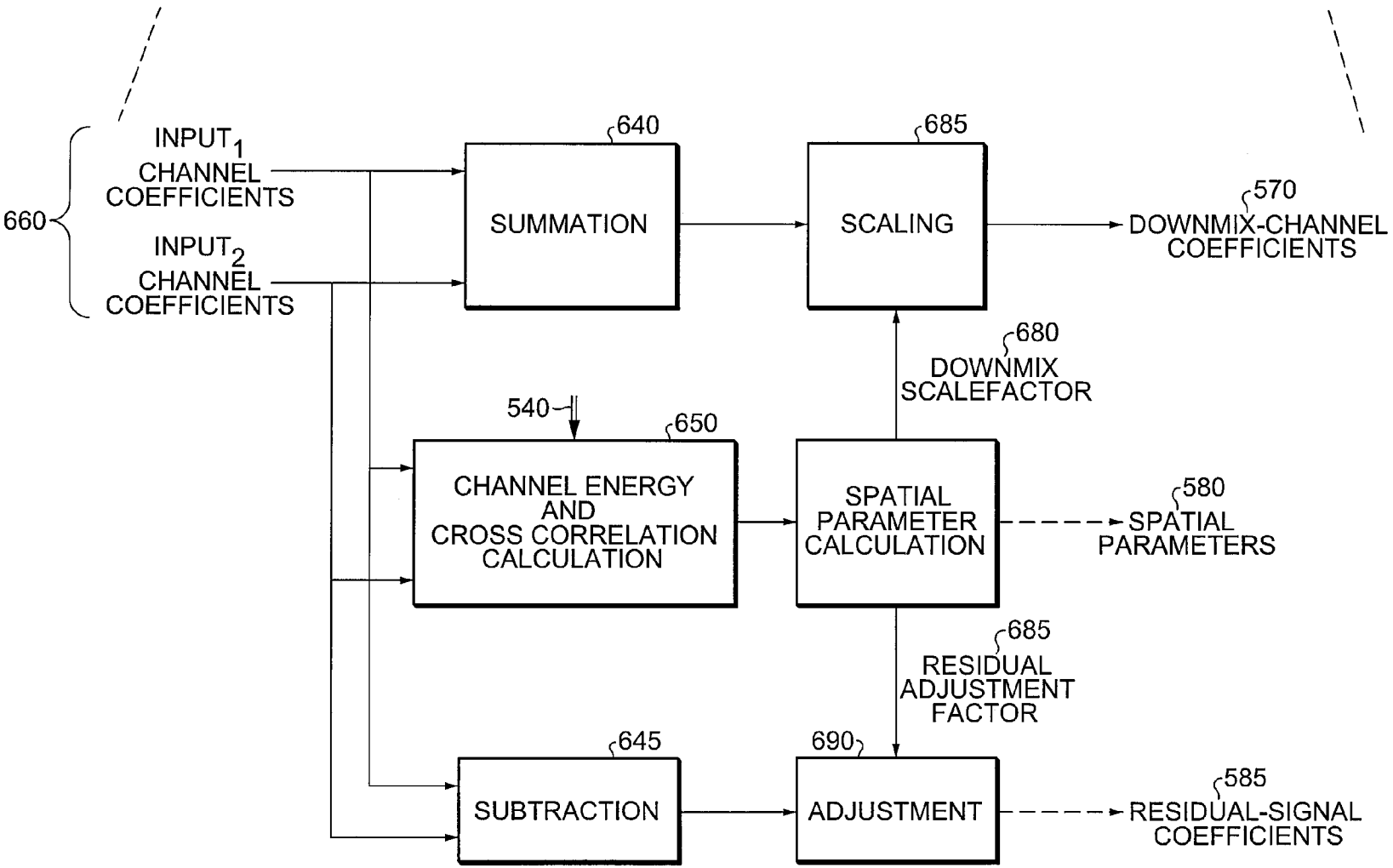

FIG. 6(*a*) illustrates the spatial encoding stage of a scheme for stereo-based encoding configuration according to one embodiment of the present invention. While the discussion that follows confers information about the encoding process from a functional point of view, one skilled in the art will recognize that each of the blocks depicted can represent specific modules, engines or devices configured to carry out the methodology described. Accordingly the block diagrams as shown are at a high level and not meant to limit the invention in any manner. Indeed the invention is only limited by claims defined at the end of this document. As opposed to the tree structure shown in FIG. 4(*b*), the actual input surround-sound channels 640 are represented by their respective channel coefficients. The same representation applies to any other encoding tree configuration, as the present invention can be implemented in several different configurations.

As shown the respective channel coefficients 660 are combined with a common input 540 to produce (at each TTO) a downmix coefficient portion 570 and a spatial parameter portion. In the example presented in FIG. 6*a*, six channel coefficients 660 are combined via three TTOs 430 to arrive at three downmix coefficients 570 and three corresponding spatial parameters and residual signals 580/585. From these three TTOs the dowmnix coefficients are joined via a TTT 440 with the same common input 540 to produce a dowmnix channel matrix 560 via a matrix compatible or 3D stereo matrix multiplication means.

FIG. 6(*b*) illustrates the operations performed at each parameter band for a TTO block according to one embodiment of the present invention. The signal energy and cross-correlation of the actual input-channel pair are calculated by combining 640 the energies and cross-correlations of the microphone array signals 540 using the channel coefficients 660. Once these values are obtained, the spatial parameters 580, residual adjustment factors 685 and downmix scalefactors 680 can be calculated using a standard formula. Simultaneously, the pair of channel coefficients 660 are summed 640 and scaled 685 using the dowmnix scalefactor 680 to derive the output-downmix channel-coefficients 570. Similarly, the residual-signal coefficients 585 can also be calculated by subtracting 645 the input-channel coefficients pair 660. The resulting signal coefficients are adjusted 690 based on the residual adjustment factor 685 to derive the residual signal coefficients 585 for the corresponding TTO block.

For a TTT block, similar operations are performed but with three input-channel coefficients and two output-downmix channel-coefficients. These output-downmix channel-coefficients form a 3×2 stereo downmix matrix which can be multiplied with the 2×2 conversion matrix if it is required to derive matrix-compatible or 3D-stereo output-downmix signals.

To better understand the implementation and wide versatility of the present invention, consider the following detailed example. Assume, for the purposes of understanding this one embodiment of the present invention, three-channel coincident microphone techniques are applicable. And for simplicity of signal labeling, B-format signals (W, X and Y) are utilized. Therefore for each surround sound channel, the channel coefficients consist of three weighting factors, $\alpha_i$, $\beta_i$, and $\gamma_i$. For coincident surround sound recording techniques with higher number of microphone array signals, the channel coefficients are appended according to one embodiment of the present invention.

Time/Frequency Filterbank

According to one aspect of the present invention, typical sampling frequencies of 32, 44.1 or 48 kHz. MPS use a hybrid analysis filterbank which comprises a cascade of 64-band exponential-modulated QMF filterbanks and low-frequency complex-modulated filterbanks. The time-domain microphone array signals are first segmented into frames of, according to one embodiment of the present invention, 2048 samples. A first filtering stage thereafter decomposes a frame of audio samples into 64 subbands of 32 complex-subband samples. The three lowest subbands are further decomposed into a total of 10 sub-subbands, while the rest of the subbands are delayed to compensate for the filtering delay. The coincident microphone array signals are essentially converted into complex subband-domain representation $W_{k,n}$, $X_{k,n}$ and $Y_{k,n}$ with k=0, . . . , 70 wherein k is the subband channel index and n=0, . . . , 31 is the complex-subband sample index. The filtering scheme is substantially identical to a parametric stereo hybrid filtering scheme for a 20 stereo-band configuration.

Microphone Array Signal Energy and Cross-Correlation Calculation

Following the analysis filtering, the microphone array signal energy $\sigma^2_{W,b}$, $\sigma^2_{X,b}$ and $\sigma^2_{Y,b}$ and cross-correlation $r_{WX,b}$, $r_{WY,b}$, $r_{XY,b}$ at each parameter band b are calculated according to $$\sigma^2_{S_i,b} = \sum_n \sum_{k=k_b}^{k_{b+1}-1} S_{i,k,n} \cdot S^*_{i,k,n}$$

$$r_{S_i S_j,b} = \mathrm{Re}\left\{ \sum_n \sum_{k=k_b}^{k_{b+1}-1} S_{i,k,n} \cdot S^*_{j,k,n} \right\}$$

where $S_i$ and $S_j$ represent any of the microphone array signals, $k_b$ refers to the subband index of the subband boundary of parameter band b, Re {Z} denotes the real part of complex signal Z, and * denotes complex conjugation. These parameter-band values form the common input 540 to all encoding blocks.

Spatial Encoding—TTO Block

According to one embodiment of the present invention, signal energy $\sigma^2 c_1$,b and $\sigma^2 c_2$,b of the actual TTO input channels $C_1$ and $C_2$ are calculated from their respective channel coefficients and the microphone array signal energy and cross-correlation. This is shown by expanding, in one embodiment, the virtual microphone operations according to $$\begin{aligned}
\sigma^2_{C_i,b} &= \sum_n \sum_{k=k_b}^{k_{b+1}-1} C_{i,k,n} \cdot C^*_{i,k,n} \\
&= \sum_n \sum_{k=k_b}^{k_{b+1}-1} (\alpha_{i,b} W_{k,n} + \beta_{i,b} X_{k,n} + \gamma_{i,b} Y_{k,n}) \cdot \\
&\quad (\alpha_{i,b} W^*_{k,n} + \beta_{i,b} X^*_{k,n} + \gamma_{i,b} Y^*_{k,n}) \\
&= \alpha^2_{i,b}\sigma^2_{W,b} + \beta^2_{i,b}\sigma^2_{X,b} + \gamma^2_{i,b}\sigma^2_{Y,b} + \\
&\quad 2\{\alpha_{i,b}\beta_{i,b} r_{WX,b} + \alpha_{i,b}\gamma_{i,b} r_{WY,b} + \beta_{i,b}\gamma_{i,b} r_{XY,b}\}
\end{aligned}$$

where i refers to the input channel index. Using similar expansion technique, the cross-correlation between the pair of input channels $r_{c1c2,b}$ is calculated according to $$r_{c1c2,b} = \alpha_1\alpha_2\sigma^2_{W,b} + \beta_1\beta_2\sigma^2_{X,b} + \gamma_1\gamma_2\sigma^2_{Y,b} + (\alpha_1\beta_2 + \alpha_2\beta_1) r_{WX,b} + (\alpha_1\gamma_2 + \alpha_2\gamma_1) r_{WY,b} + (\beta_1\gamma_2 + \beta_2\gamma_1) r_{XY,b}$$

From these values, the spatial parameters Channel Level Difference ("CLD"), Inter Channel Correlation ("ICC") and downmix scalefactor $g_b$ are calculated according to:

$$CLD_b = 10\log_{10}\frac{\sigma^2_{C_1,b}}{\sigma^2_{C_2,b}}$$

$$ICC_b = \frac{r_{C_1C_2,b}}{\sigma_{C_1,b}\sigma_{C_2,b}}$$

-continued $$g_{c_1c_2b} = \sqrt{\frac{\sigma^2_{c_1,b} + \sigma^2_{c_2,b}}{\sigma^2_{c_1,b} + \sigma^2_{c_2,b} + 2r_{c_1c_2,b}}}$$

The input channel coefficients are subsequently mixed and scaled according to $$\begin{bmatrix} \alpha_{Downmix0,b} \\ \beta_{Downmix0,b} \\ \gamma_{Downmix0,b} \end{bmatrix} = g_{c1c2b} \begin{bmatrix} \alpha_{1,g} + \alpha_{2,b} \\ \beta_{1,b} + \beta_{2,b} \\ \gamma_{1,b} + \gamma_{2,b} \end{bmatrix}$$

to derive the monaural downmix-channel coefficients.

Spatial Encoding—TTT Block

Similar to TTO, signal energies $\sigma^2_{c1,b}$, $\sigma^2_{c2,b}$, $\sigma^2_{c3,b}$ and cross-correlations $r_{c1c2,b}$, $r_{c1c3,b}$, $r_{c2c3,b}$ of the actual input channel triplet $C_1$, $C_2$, and $C_3$ can be calculated. For TTT block operating in energy mode, the spatial parameter $CLD_1$ and $CLD_2$ are calculated according to $$CLD_{1,b} = 10\log_{10}\frac{\sigma^2_{c1,b} + \sigma^2_{c2,b}}{\frac{1}{2}\sigma^2_{c3,b}}$$

$$CLD_{2,b} = 10\log_{10}\frac{\sigma^2_{c1,b}}{\sigma^2_{c2,b}}$$

assuming that $C_3$ is the common channel which is attenuated by 3 dB and mixed to the other channels to derive the stereo output-downmix. Two downmix scalefactors $g_{c1c3,b}$ and $g_{c2c3,b}$ are calculated according to the formula presented in the previous section, taking into account the 3 dB signal attenuation of input channel $C_3$.

For TTT block operating in prediction mode, depending on the optimization method, there are many solutions to derive the prediction coefficients. According to one embodiment of the present invention a solution can be based on the minimization of the prediction error. This solution utilizes the input-channel signal energies and cross-correlations calculated. In this mode of operation, the dowumix scalefactors are set to 1.

The input channel coefficients are mixed and scaled according to $$\begin{bmatrix} \alpha_{Downmix1,b}\alpha_{Downmix2,b} \\ \beta_{Downmix1,b}\beta_{Downmix2,b} \\ \gamma_{Downmix1,b}\gamma_{Downmix2,b} \end{bmatrix} = \left[ g_{c2c3,b} \begin{bmatrix} \alpha_{1,b} + \frac{1}{2}\sqrt{2}\,\alpha_{3,b} \\ \beta_{1,b} + \frac{1}{2}\sqrt{2}\,\beta_{3,b} \\ \gamma_{1,b} + \frac{1}{2}\sqrt{2}\,\gamma_{3,b} \end{bmatrix} g_{c2c3,b} \begin{bmatrix} \alpha_{2,b} + \frac{1}{2}\sqrt{2}\,\alpha_{3,b} \\ \beta_{2,b} + \frac{1}{2}\sqrt{2}\,\beta_{3,b} \\ \gamma_{2,b} + \frac{1}{2}\sqrt{2}\,\gamma_{3,b} \end{bmatrix} \right]$$

to derive the stereo-downmix channel coefficients. Matrix-compatible or 3D-stereo output-downmix can then be derived by multiplying this 3×2 downmix-channel matrix with the 2×2 conversion matrix.

Downmix Signal Derivation

According to another embodiment of the present invention, output-downmix signals are derived by applying the output-downmix channel-coefficients matrix from the last encoding stage to the microphone array signals according to $$\text{Downmix}_{i,k,n} = \alpha_{Downmixi,b}W_{k,n} + \beta_{Downmixi,b}X_{k,n} + \gamma_{Downmixi,b}Y_{k,n}$$

where i refers to the downmix-channel index.

At any point in an encoding block, signal mixing operations can be carried out by mixing the input-channel coefficients accordingly. For example, the residual signal for a TTO block can be obtained by subtracting and averaging the input-channel coefficients pair. The desired signal can then be derived by applying the resulting coefficients to the microphone array signals according to the method shown in the previous paragraph.

Figure 7:
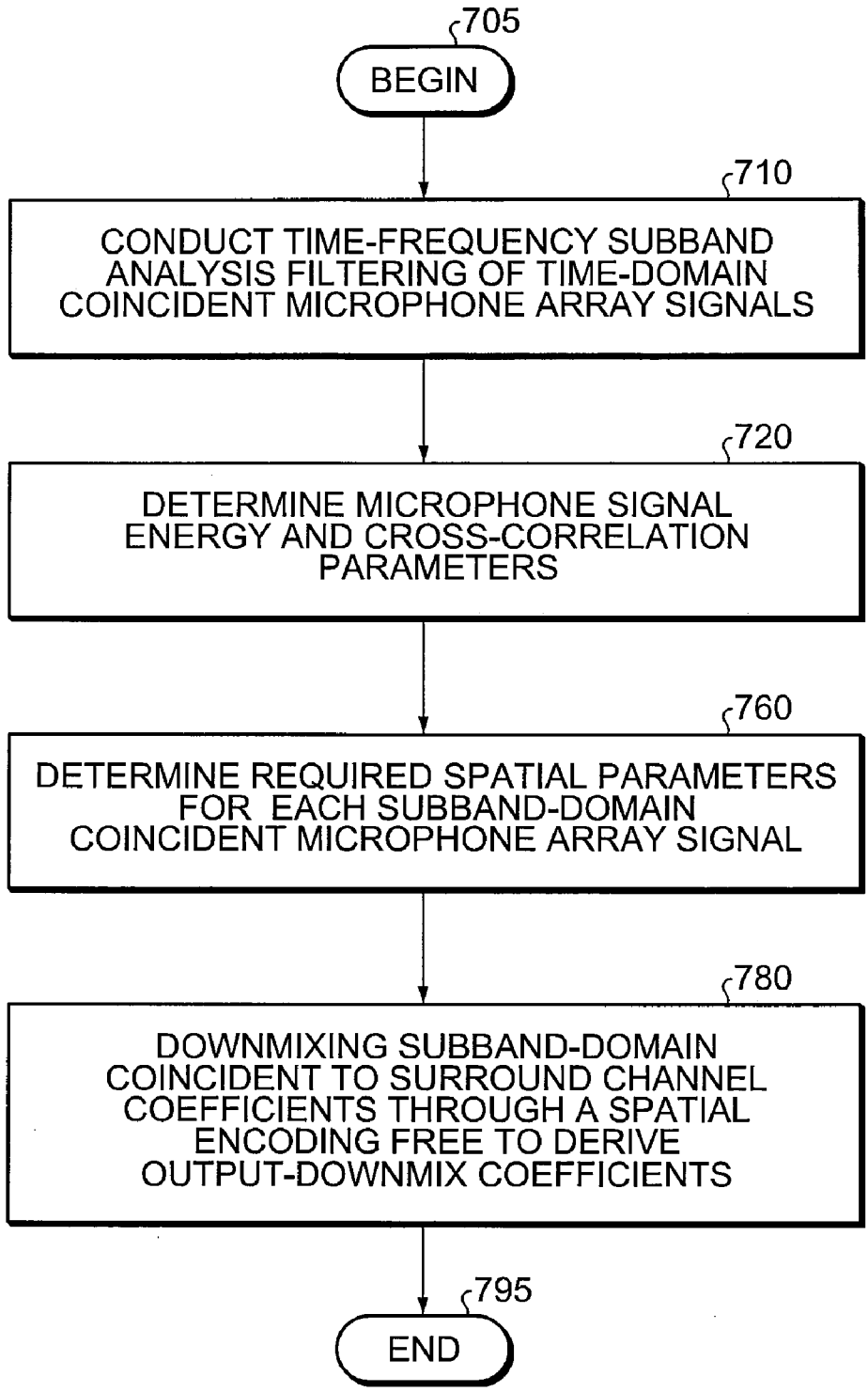
FIG. 7 is a flowchart for one embodiment of a method for MPEG Surround encoding for surround sound recordings with coincident microphones, according to the present invention.

FIG. 7 is a flowchart illustrating methods of implementing an exemplary method for MPS encoding for surround sound recordings with coincident microphones. In the following description, it will be understood that each block of the flowchart illustrations, and combinations of blocks in the flowchart illustrations, can be implemented by computer program instructions. These computer program instructions may be loaded onto a computer or other programmable apparatus to produce a machine such that the instructions that execute on the computer or other programmable apparatus create means for implementing the functions specified in the flowchart block or blocks. These computer program instructions may also be stored in a computer-readable memory that can direct a computer or other programmable apparatus to function in a particular manner such that the instructions stored in the computer-readable memory produce an article of manufacture including instruction means that implement the function specified in the flowchart block or blocks. The computer program instructions may also be loaded onto a computer or other programmable apparatus to cause a series of operational steps to be performed in the computer or on the other programmable apparatus to produce a computer implemented process such that the instructions that execute on the computer or other programmable apparatus provide steps for implementing the functions specified in the flowchart block or blocks.

Accordingly, blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware-based computer systems that perform the specified functions or steps, or combinations of special purpose hardware and computer instructions.

As previously discussed the encoding process begins 705 with conducting 710 time/frequency subband analysis filtering of time-domain coincident microphone array signals to produce frequency subdomain inputs. Thereafter microphone signal energy and cross-correlation parameters are determined 720 for each of the plurality of subband-domain coincident microphone array signals forming a plurality of parameter band values.

Based on these band values and a plurality of subband-domain coincident-to-surround channel coefficients, required spatial parameters are determined 760. Then through a spatial encoding tree the plurality of subband-domain coincident-to-surround channel coefficients are downmixed 780 to derive a plurality of output-downmix channel coefficients. Using these downmix coefficients a downmix signal can be formed ending 795 the encoding process.

According to one aspect of the present invention, energy of each subband-domain coincident microphone array signal and cross-correlation between pairs of the subband-domain coincident microphone array signals are calculated and grouped according to at least one MPS parameter band to form a common input to all Two-to-One and Three-to-Two encoding blocks. Furthermore, parameter-band energies and cross-correlations of Two-to-One encoding blocks or Three-to-Two encoding blocks are determined from the common input and a corresponding triplet pair of coincident-to-surround channel coefficients. These parameter-band energies and cross-correlations are utilized to calculate required spatial parameters and downmix scale factors.

According to another embodiment of the present invention, a residual channel coefficient for each corresponding encoding block can be determined by subtracting and adusting the subband-domain coincident-to-surround channel coefficients. Residual signals, as well as output-downix signals can be derived by matrixing the subband-domain coincident microphone array signals with the output-downmix and residual channel coefficients. And matrix-compatible process signals can be found by multiplying the output-downmix channel coefficient matrix with a stereo-dowmnix conversion matrix.

Embodiments of the present invention provide a new MPS encoder structure for coincident surround sound recordings. This encoder structure can be determined by deriving the spatial parameters and output-downmix signals from coincident microphone array signals and a channel-coefficients matrix. With this method, the dependency of the memory and computational demand on the number of surround audio channels is reduced and/or eliminated, while the required spatial parameter and output-downmix signals can still be fully derived. Furthermore, Stereo-downmix conversion can be integrated efficiently without adding significant computational requirements. As a result of embodiments of the present invention, the overall computational demand is significantly lower than that required by previous MPS encoders.

As will be understood by those familiar with the art, the invention may be embodied in other specific forms without departing from the spirit or essential characteristics thereof. Likewise, the particular naming and division of the modules, managers, functions, systems, engines, layers, features, attributes, methodologies, and other aspects are not mandatory or significant, and the mechanisms that implement the invention or its features may have different names, divisions, and/or formats. Furthermore, as will be apparent to one of ordinary skill in the relevant art, the modules, managers, functions, systems, engines, layers, features, attributes, methodologies, and other aspects of the invention can be implemented as software, hardware, firmware, or any combination of the three. Of course, wherever a component of the present invention is implemented as software, the component can be implemented as a script, as a standalone program, as part of a larger program, as a plurality of separate scripts and/or programs, as a statically or dynamically linked library, as a kernel loadable module, as a device driver, and/or in every and any other way known now or in the future to those of skill in the art of computer programming. Additionally, the present invention is in no way limited to implementation in any specific programming language, or for any specific operating system or environment. Accordingly, the disclosure of the present invention is intended to be illustrative, but not limiting, of the scope of the invention, which is set forth in the following claims.

While there have been described above the principles of the present invention in conjunction with MPS encoding for surround sound recordings with coincident microphones, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

We claim:

1. A method for MPEG Surround spatial audio encoding of coincident surround sound recordings, the method comprising:

conducting time-frequency subband analysis filtering of time-domain coincident microphone array signals producing a plurality of subband-domain coincident microphone array signals;

determining microphone signal energy and cross-correlation parameters for each of a plurality of MPEG Surround parameter bands, said bands associated with each of the plurality of subband-domain coincident microphone array signals, forming a plurality of parameter band values;

determining required spatial parameters based on the plurality of parameter band values and a plurality of subband-domain coincident-to-surround channel coefficients, said subband-domain coincident-to-surround channel coefficients being in a matrix that maps the subband-domain coincident microphone array signals to subband-domain multi-channel surround signals; and downmixing the plurality of subband-domain coincident-to-surround channel coefficients through a spatial encoding tree to derive a plurality of output-downmix channel coefficients.

2. The method of claim 1 wherein said plurality of output-downmix channel coefficients are in a matrix mapping subband-domain coincident microphone array signals to subband-domain output-downmix signals suitable for MPEG Surround spatial audio decoding.

3. The method of claim 1 wherein energy of each subband-domain coincident microphone array signal and cross-correlations between pairs of the subband-domain coincident microphone array signals are calculated and grouped according to at least one MPEG Surround parameter band and a resulting band value form a common input to all Two-to-One and Three-to-Two encoding blocks.

4. The method of claim 1 wherein spatial encoding at each encoding block of the spatial encoding tree is based on a common input and subband-domain coincident-to-surround channel coefficients.

5. The method of claim 4 wherein parameter-band energies and cross-correlations of input signals of Two-to-One encoding blocks or Three-to-Two encoding blocks are determined from the common input and a corresponding triplet pair of coincident-to-surround channel coefficients, and wherein these parameter-band energies and cross-correlations are utilized to calculate required spatial parameters and downmix scale factors.

6. The method of claim 5 wherein the subband-domain coincident-to-surround channel coefficients are combined resulting in mixed subband-domain coincident-to-surround channel coefficients and wherein the mixed subband-domain coincident-to-surround channel coefficients are multiplied with said downmix scale factors to result in downmix channel coefficients that are passed to subsequent encoding blocks as subband-domain coincident-to-surround channel coefficients.

7. The method of claim 6 wherein the downmix channel coefficients of a last encoding block in the encoding tree form an output-downmix channel matrix.

8. The method of claim 6 wherein output-downmix and residual signals are derived by matrixing the subband-domain coincident microphone array signals with the output-downmix and residual channel coefficients.

9. The method according to claim 6 further comprising multiplying the output-downmix channel coefficient matrix with a stereo-downmix conversion matrix to convert default stereo output-downmix signals into matrix-compatible or 3D stereo processed signals.

10. The method according to claim 4 wherein the subband-domain input-channel coefficients are summed, scaled and navigated through the spatial encoding tree to derive output-downmix channel coefficients.

11. The method according to claim 4 wherein a pair or triplet of subband-domain coincident-to-surround channel coefficients are subtracted from each other and then adjusted to derive residual channel coefficients of a corresponding encoding block.

12. The method of claim 1 wherein spatial parameters and output-downmix signals are derived from subband-domain coincident microphone array signals and the coincident-to-surround channel-coefficients.

13. The method of claim 1 wherein output-downmix signals from the subband-domain coincident microphone array signals are based on the output-downmix channel coefficients.

14. A computer system for encoding coincident surround sound recordings the computer system comprising:

a machine capable of executing instructions embodied as software; and a plurality of software portions, wherein one of said software portions is configured to conduct time-frequency subband analysis filtering of time-domain coincident micro-phone array signals producing a plurality of subband-domain coincident microphone array signals;

one of said software portions is configured to determine microphone signal energy and cross-correlation parameters for each of a plurality of MPEG Surround parameter bands forming a plurality of parameter band values;

one of said software portions is configured to determine required spatial parameters based on the plurality of parameter band values and a plurality of subband-domain coincident-to-surround channel coefficients, said subband-domain coincident-to-surround channel coefficients being in a matrix that maps the subband-domain coincident microphone array signals to subband-domain multi-channel surround signals; and one of said software portions is configured to downmix the plurality of subband-domain coincident-to-surround channel coefficients through a spatial encoding tree to derive a plurality of output-downmix channel coefficients.

15. The computer system of claim 14 wherein one of said software programs is configured to calculate and group energy of each subband-domain coincident microphone array signal and cross-correlations between pairs of the subband-domain coincident microphone array signals according to at least one MPEG Surround parameter band and a resulting band value from a common input to all Two-to-One and Three-to-Two encoding blocks.

16. The computer system of claim 15 wherein spatial encoding at each encoding block of the spatial encoding tree is based on a common input and subband-domain coincident-to-surround channel coefficients.

17. The computer system of claim 16 wherein one of said software portions is configured to determine parameter-band energies and cross-correlations of Two-to-One encoding blocks or Three-to-Two encoding blocks from the common input and a corresponding triplet or pair of coincident-to-surround channel coefficients, and wherein these parameter-band energies and cross-correlations are utilized to calculate required spatial parameters and downmix scale factors.

18. The computer system of claim 14 wherein one of said software portions is configured to derive spatial parameters and output-downmix signals from subband-domain coincident microphone array signals and the coincident-to-surround channel-coefficients.

19. A computer-readable storage medium tangibly embodying a program of instructions executable by a machine wherein said program of instruction comprises a plurality of program codes for encoding coincident surround sound recordings, said program of instructions comprising program code for:

conducting time-frequency subband analysis filtering of time-domain coincident microphone array signals producing a plurality of subband-domain coincident microphone array signals;

determining microphone signal energy and cross-correlation parameters for each of a plurality of MPEG Surround parameter bands, said bands associated with each of the plurality of subband-domain coincident microphone array signals, forming a plurality of parameter band values;

determining required spatial parameters based on the plurality of parameter band values and a plurality of subband-domain coincident-to-surround channel coefficients, said subband-domain coincident-to-surround channel coefficients being in a matrix that maps the subband-domain coincident microphone array signals to subband-domain multi-channel surround signals; and downmixing the plurality of subband-domain coincident-to-surround channel coefficients through a spatial encoding tree to derive a plurality of output-downmix channel coefficients.

* * * * *

UNITED STATES PATENT AND TRADEMARK OFFICE

CERTIFICATE OF CORRECTION

PATENT NO. : 8,332,229 B2
APPLICATION NO. : 12/405133
DATED : December 11, 2012
INVENTOR(S) : Samsudin and Sapna George It is certified that error appears in the above-identified patent and that said Letters Patent is hereby corrected as shown below:

On the title page, item (12) "et al." should be --Samsudin et al.--

Signed and Sealed this
Second Day of December, 2014

Michelle K. Lee

Michelle K. Lee
*Deputy Director of the United States Patent and Trademark Office*